US009838810B2

(12) United States Patent
Singer et al.

(10) Patent No.: US 9,838,810 B2
(45) Date of Patent: Dec. 5, 2017

(54) LOW POWER AUDIO DETECTION

(71) Applicant: Qualcomm Technologies International, Ltd., Cambridge (GB)

(72) Inventors: Steven Mark Singer, Cambridge (GB); Harith Haboubi, Cambridge (GB); Peter Williams, Cambridge (GB)

(73) Assignee: QUALCOMM TECHNOLOGIES INTERNATIONAL, LTD., Cambridge (GB)

( * ) Notice: Subject to any disclaimer, the term of this patent is extended or adjusted under 35 U.S.C. 154(b) by 499 days.

(21) Appl. No.: 13/776,882

(22) Filed: Feb. 26, 2013

(65) Prior Publication Data

US 2013/0223635 A1 Aug. 29, 2013

Related U.S. Application Data

(60) Provisional application No. 61/603,717, filed on Feb. 27, 2012.

(51) Int. Cl.
*H04R 29/00* (2006.01)
*H04R 1/10* (2006.01)

(52) U.S. Cl.
CPC ..... *H04R 29/00* (2013.01); *H04R 1/1041* (2013.01); *H04R 1/1083* (2013.01);
(Continued)

(58) Field of Classification Search
CPC ..... G10L 15/00
(Continued)

(56) References Cited

U.S. PATENT DOCUMENTS 6,070,140 A 5/2000 Tran
7,418,392 B1 * 8/2008 Mozer ..... G10L 15/26 315/307
(Continued)

FOREIGN PATENT DOCUMENTS

KR 20120066561 6/2012
WO WO 1997/07437 2/1997
(Continued)

OTHER PUBLICATIONS

"Learn More About Siri", https://www.apple.com/uk/ios/siri/siri-faq/ Apple (United Kingdom) iOS—Siri FAQ, Feb. 11, 2013.
(Continued)

*Primary Examiner* — Duc Nguyen
*Assistant Examiner* — Phan Le
(74) *Attorney, Agent, or Firm* — Paradice and Li LLP

(57) ABSTRACT

Devices and methods of detecting a predetermined audio signal in audio signals are provided. A device includes a processor coupled to a clock signal generator, a power controller and an audio detector. The power controller controls a clock rate provided to the processor by the clock signal generator, to control the device to operate in a low power mode having a relatively low power consumption or in a normal power mode having a relatively high power consumption. The audio detector receives audio signals and detects, in the low power mode, probable presence of a predetermined audio signal in the audio signals. The power controller controls the device to switch from the low power mode to the normal power mode responsive to the detected presence of the predetermined audio signal by the audio detector.

29 Claims, 5 Drawing Sheets

(52) U.S. Cl.
CPC ..... *H04R 2420/07* (2013.01); *H04R 2460/03* (2013.01); *H04R 2499/11* (2013.01); *H04R 2499/13* (2013.01); *H04R 2499/15* (2013.01)

(58) Field of Classification Search
USPC ..... 381/56, 57; 375/259
See application file for complete search history.

(56) References Cited

U.S. PATENT DOCUMENTS

| | | | | |
|---|---|---|---|---|
| 8,224,286 | B2 | 7/2012 | Sinivaara | |
| 2003/0130852 | A1 | 7/2003 | Tanaka et al. | |
| 2004/0131214 | A1* | 7/2004 | Galler et al. | 381/323 |
| 2005/0141741 | A1* | 6/2005 | Van Oerle | H04R 25/505 381/323 |
| 2008/0267416 | A1* | 10/2008 | Goldstein | H04R 1/1091 381/56 |
| 2009/0017879 | A1 | 1/2009 | Tsfaty et al. | |
| 2009/0110206 | A1* | 4/2009 | Haggis et al. | 381/58 |
| 2011/0065413 | A1 | 3/2011 | Singer | |
| 2011/0078275 | A1 | 3/2011 | Lowe et al. | |
| 2011/0249836 | A1* | 10/2011 | Solum | H04R 25/558 381/314 |

FOREIGN PATENT DOCUMENTS

| | | |
|---|---|---|
| WO | WO 2004/015643 | 2/2004 |
| WO | WO 2011/127457 | 10/2011 |

OTHER PUBLICATIONS

"Common Commands in Speech Recognition", https://windows/microsoft.com/cp,/en-US/windows7/Common-commands-in-Speech-Recognition Feb. 11, 2013.

"Noise Gate" https://en.wikipedia.org/wiki/Noise_gate Jan. 14, 2013.

"Dynamics Processing Terms and Tips", http://www.presonus.com/community/Learn/Dynamics-Processing-Terms-and-Tips Feb. 11, 2013.

GB Search Report for GB Appln. No. 1303502.7, dated Aug. 14, 2013.

Intel: "Intel Pentium M Processor Datasheet", published 2004, pp. 1-75, Intel. Available from http://download.intel.com/support/processors/mobile/pm/sb/25261203.pdf [accessed Mar. 28, 2017].

* cited by examiner

LOW POWER AUDIO DETECTION

CROSS REFERENCE TO RELATED APPLICATIONS

This application claims priority to U.S. Provisional Application Ser. No. 61/603,717, entitled "LOW POWER AUDIO DETECTION," filed Feb. 27, 2012, incorporated fully herein by reference.

FIELD OF THE INVENTION

The present invention is directed generally to reducing power consumption in devices, and, more particularly, to devices and methods for detecting probable presence of a predetermined audio signal in audio signals while reducing power consumption in a device.

BACKGROUND OF THE INVENTION

Various devices have a limited energy supply, such as those that are powered by batteries. Some devices exist which may respond to voice commands or other occasional predetermined sounds (generally referred to herein as audio of interest). In general, devices may process an audio signal to detect any audio of interest. Most of the time, however, there is no audio of interest present in the audio signal. Furthermore, processing of the audio signal may cause the device to consume current, thereby increasing a power consumption in the device. The audio signal processing, thus, may limit a battery lifetime (notably a stand-by time) of the device.

SUMMARY OF THE INVENTION

The present invention is embodied in devices and methods of detecting a predetermined audio signal in audio signals. A device includes a processor coupled to a clock signal generator, a power controller and an audio detector. The power controller is configured to control a clock rate provided to the processor by the clock signal generator, to control the device to operate in a low power mode having a relatively low power consumption or in a normal power mode having a relatively high power consumption. The audio detector is coupled to the power controller. The audio detector is configured to receive audio signals and to detect, in the low power mode, probable presence of a predetermined audio signal in the audio signals. The power controller controls the device to switch from the low power mode to the normal power mode responsive to the detected presence of the predetermined audio signal by the audio detector.

BRIEF DESCRIPTION OF THE DRAWINGS

The invention may be understood from the following detailed description when read in connection with the accompanying drawing. It is emphasized, according to common practice, that various features of the drawing may not be to scale. On the contrary, the dimensions of the various features may be arbitrarily expanded or reduced for clarity. Moreover, in the drawing, common numerical references are used to represent like features. Included in the drawing are the following figures.

DETAILED DESCRIPTION OF THE INVENTION

Figure 1A:
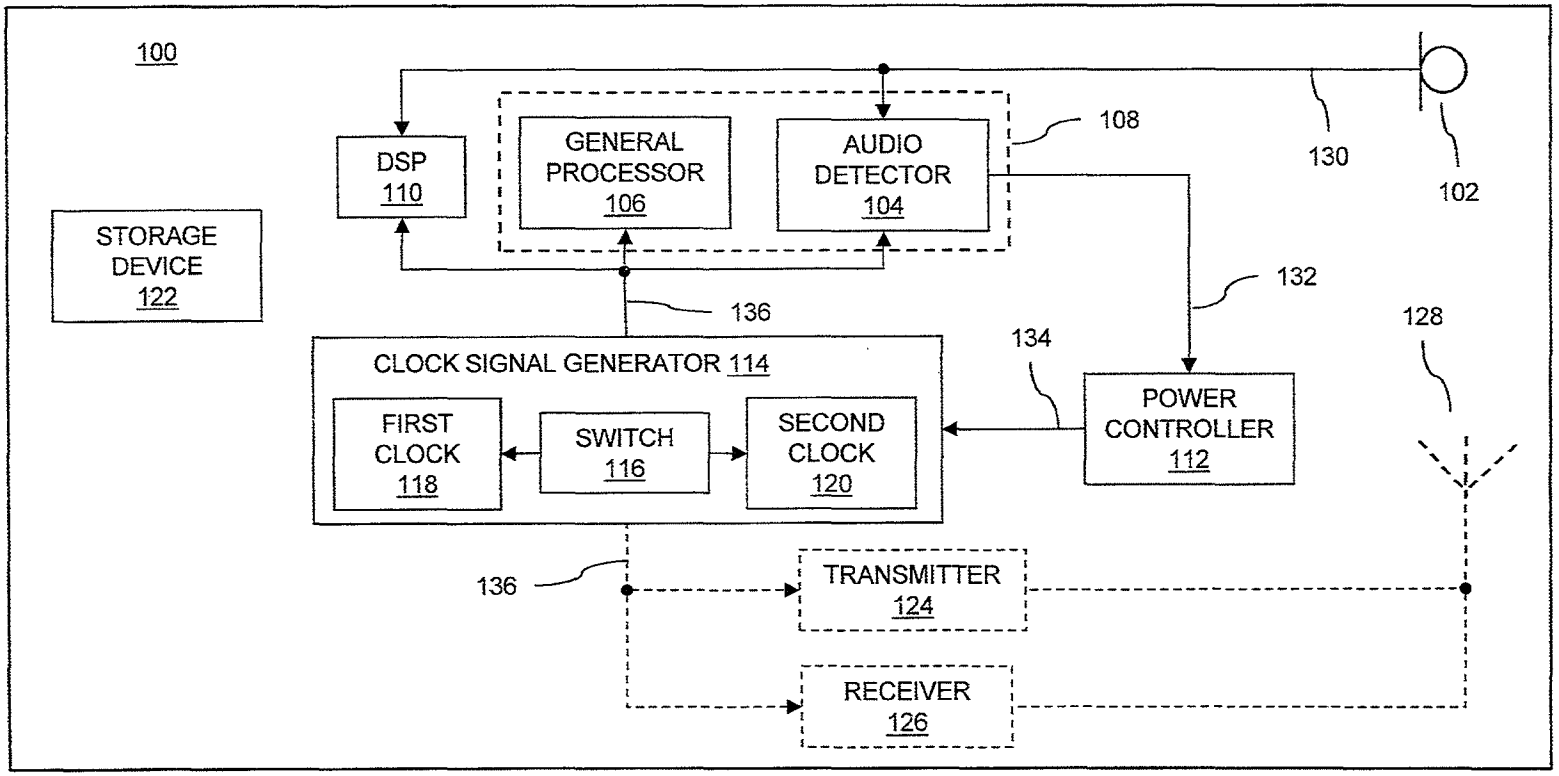
FIG. 1A is a functional block diagram of a device which detects a predetermined audio signal, according to an embodiment of the present invention.

As discussed above, conventional devices may process an audio signal to detect audio of interest. Devices may, for example, use conventional voice recognition techniques to continually process the audio signal for audio of interest. These techniques, however, may result in relatively high power consumption. One alternative technique may be to periodically process a small burst of audio. For example, 10 ms of audio may be sampled every 100 ms to determine whether any audio of interest is present.

Other techniques that may be used to indicate the start of audio of interest include direct input by a user to an input component of the device, such as a push-button. However, this may require that the device be accessible to a user and that it be equipped with a suitable input component. Furthermore, button presses may interrupt a smooth user experience. As another example, some devices may use a simple electronic threshold detection (i.e., a noise gate) to indicate the start of audio of interest. A simple noise gate, however, may provide too many false positive results in noisy environments and too many false negative results in quiet environments.

Various devices may include a low power mode and a normal power mode. In the low power mode, the energy consumption is typically reduced (compared to the normal power mode) by disabling some of the functions of the device. The low power mode may be useful, for example, for battery-powered devices.

One audio detection technique (such as voice recognition or periodic processing of small bursts of audio) may use a normal power mode processing capability of the system. For example, voice recognition techniques typically involve a digital signal processor (DSP) capable of identifying keywords in an audio signal. Continual use of the DSP may involve higher power consumption in the device. Periodic processing of small bursts of audio may also involve waking up significant parts of the system that aren't involved in audio processing, for example, one or more application processors, a general purpose random access memory (RAM) or wired communication hardware (such as a Universal Asynchronous Receiver-Transmitter (UART), a Universal Serial Bus (USB), a Secure Digital Input Output (SDIO), etc.). These components will consume power while the audio processing is taking place.

A mobile device may intermittently or continuously detect audio activity, even during an idle mode (where the device is not actively running any application in response to a user's manual input). The device may automatically start and end logging of an audio signal based on detected audio activity. The precision of an analog to digital converter (ADC) may be controlled (by changing the sampling frequency of the ADC), such that the ADC has a lower precision during a passive audio monitoring state and a higher precision for an active audio logging state, to reduce power consumption or memory usage.

Aspects of embodiments of the present invention relate to devices and methods for detecting probable presence of a predetermined audio signal (i.e., audio of interest) in audio signals. An exemplary device includes a processor coupled to a clock signal generator, a power controller and an audio detector. The power controller may be configured to control a clock rate provided to the processor by the clock signal generator, to control the device to operate in a low power mode having a relatively low power consumption or in a normal power mode having a relatively high power consumption. The audio detector is configured to receive audio signals and to detect, in the low power mode, probable presence of a predetermined audio signal in the audio signals. The power controller controls the device to switch from the low power mode to the normal power mode responsive to the detected presence of the predetermined audio signal by the audio detector.

Exemplary devices and methods embodying the present invention include audio detection in a low power mode. Under the low power mode, a clock rate provided to a processor of the device is lower than during a normal power mode. The lower clock rate may be provided to other peripheral components of the device, as well as to the audio detector. An exemplary audio detector may detect the probable presence of a predetermined audio signal, based on some aspects of the audio signal. Example embodiments of an audio detector may include more advanced processing than a simple noise gate. Example embodiments of the audio detector may also include more limited processing than conventional audio recognition techniques (such as identification of a keyword). Because exemplary audio detectors may not identify all aspects of the predetermined audio signal, they may have a reduced detection accuracy as compared with audio processing performed during a normal power mode.

According to an exemplary embodiment, the device may provide more than one level of audio processing, with the audio detector detecting, in the low power mode, the probable presence of the predetermined signal and a DSP detecting, in the normal power mode, the predetermined signal. Thus, the audio detector may perform detection with a lower accuracy with reduced power consumption (under the low power mode) while the DSP may perform higher accuracy detection with higher power consumption (under the normal power mode), responsive to the audio detector.

A difference between audio detection of the present invention and conventional full processing of audio is that, with the present invention, when the device is in an idle state (that is, before a start of audio of interest), the device can be in a low power mode. A difference between low-power audio detection and other techniques (such as noise gating) to mark the start of audio of interest is that low-power audio detection may provide better selectivity (i.e., better detection accuracy) for triggers while running in a low power mode. In general, exemplary audio detectors may use significantly lower power (at least an order of magnitude) than other audio detectors and may be less likely to miss triggers than noise gates.

One audio detection system includes a wireless headset and a mobile phone. The system may use direct user input (a button press) on the wireless headset to initiate detection of voice commands. Once the user input is received, audio from the headset may be routed to the mobile phone for voice processing. If voice commands were to be recognized by this conventional system using voice activation (instead of by direct user input), one way to do so would be by initiating a full wireless connection (such as Bluetooth™), routing all of the audio to the mobile phone and performing voice processing on the phone. Not only does this consume power in an application processor on the mobile phone and in ADCs on the headset, but it consumes power in the Bluetooth chip on the phone and the Bluetooth chip on the headset. Accordingly, this technique may result in poor battery life, especially on the headset.

If, on the other hand, the keyword detection is performed by the headset (in a normal power mode), the mobile phone can go to sleep completely and the headset can put its Bluetooth link into a lower power mode until the keyword is detected. If the main processor of the headset performs the keyword detection in the normal power mode, however, the power consumption still does not produce an adequate stand-by time on the headset. If, however, low power audio detection techniques are performed by the headset (in accordance with aspects of the present invention), the power consumption of the headset may be reduced, thus increasing the stand-by time of the headset.

Referring to FIG. 1A, a functional block diagram of an example device 100 is shown. Device 100 may include microphone 102, audio detector 104, general processor 106, digital signal processor (DSP) 110, power controller 112, clock signal generator 114 and storage device 122. Device 100 may include other functional components, such as, without being limited to, optional transmitter 124, optional receiver 126 and optional antenna 128. General processor 106 and storage device 122 may be coupled to audio detector 104, DSP 110, power controller 112, clock signal generator 114, optional transmitter 124, optional receiver 126 and/or optional antenna 128 via a data and control bus (not shown).

Device 100 may include any device having a limited power supply capable of detecting a predetermined audio signal. Examples of device 100 may include, without being limited to, a wireless headset, a mobile phone, a personal digital assistant (PDA), a computer, a television, a remote control, an in-car entertainment center, an AM/FM radio, a clock or a watch.

Device 100 may be configured to operate in a low power mode or in a normal power mode based on a clock rate of clock signal generator 114. Selection of a power mode may be controlled by power controller 112, according to detection of a predetermined audio signal in audio signals 130 by audio detector 104. The predetermined audio signal may include, for example, a predetermined voice signal or a predetermined non-voice audio signal (e.g., a whistle, a clap, a click, etc.).

In operation, audio detector 104 may perform audio detection on audio signals 130 while device 100 is in the low power mode. When probable presence of a predetermined audio signal (i.e., audio of interest) is detected, power controller 112 may switch device 100 to operate in the normal power mode. In general, audio processing by audio detector 104 in the low power mode may cause device 100 to consume less current than if device 100 were operated in the normal power mode.

Microphone 102 may capture audio signals 130 from a surrounding environment. According to one embodiment, microphone 102 may include an analog microphone, such that audio signals 130 may represent an analog signal. According to another embodiment, microphone 102 may include a digital microphone, such that audio signals 130 may represent a digital signal. For example, microphone 102 may include an analog to digital convertor (ADC) (not shown) to produce the digital signal. Audio signals 130 may be provided to at least one of audio detector 104, general processor 106 or DSP 110. Audio signals 130 may also be stored in storage device 122, described further below.

Audio detector 104 may receive audio signals 130 and may detect the predetermined audio signal in audio signals 130, to generate detection signal 132. Detection signal 132 may be provided to power controller 112. Audio detector 104 may perform audio detection while device 100 is in the low power mode. Audio detection may be performed continuously or periodically during the low power mode. Audio detector 104 is described further below with respect to FIGS. 2 and 3. Audio detector 104 may include, for example, a logic circuit, a digital signal processor or a microprocessor.

In general, audio detector 104 may perform some audio processing of audio signals 130, based on a comparison of audio signals 130 to a predetermined audio signal. Audio detector 104 may provide more processing capability than a noise gate, but may not provide the detection accuracy of processing performed under the normal power mode (for example, as may be performed by DSP 110).

Detection accuracy of audio detector 104 may be controlled based on a clock rate of clock signal 136 provided to audio detector 104 (described further below). According to an exemplary embodiment, audio detector 104 may have sufficient accuracy to detect probable presence of the predetermined audio signal in audio signals 130. Audio detector 104, however, may not be able to detect all aspects of the predetermined audio signal. For example, audio detector 104 may detect the probable presence of a voice signal, but may not be able to identify keywords in the voice signal.

Audio detector 104 may process an analog signal and/or a digital signal. According to an example embodiment, audio detector 104 may process a digital signal (e.g., from microphone 102 configured as a digital microphone) which includes a user's voice. The clock rate (e.g., 32 kHz) of clock signal 136 provided to audio detector 104 in the low power mode may be too low for full voice reconstruction of the digital signal. Audio detector 104, however, may still recover aspects of audio signals 130 which may be useful for determining the probable presence of the user's voice.

General processor 106 may perform general functions related to the operation of device 100. General processor 106 may not be optimized for power consumption when performing any particular task (such as audio signal processing). In other words, general processor 106 may have some audio signal processing capabilities (including capabilities greater than a noise gate), but may not be optimized for signal processing (such as DSP 110). General processor 106 may also be configured to perform audio signal processing at a lower clock rate (during the low power mode). General processor 106 may control operation of one or more of microphone 102, audio detector 104, DSP 110, power controller 112, clock circuit 114, storage device 122, optional transmitter 124, optional receiver 126 and optional antenna 128. General processor 106 may include, for example, a logic circuit, a digital signal processor, a microcontroller or a microprocessor. According to an example embodiment, general processor 106 may include, without being limited to, an Intel 8051 processor.

In contrast to general processor 106, DSP 110 may be optimized for a specific task (such as audio signal processing), and that optimization may reduce the power consumption for performing that task (in comparison to general processor 106). DSP 110 may include any suitable digital signal processor capable of performing audio signal processing. DSP 110, in general, may analyze a spectrum of audio signals 130 to determine whether the predetermined audio signal is present. DSP 100 may perform any suitable audio recognition technique (such as voice recognition using hidden Markov models (HMMs)) or neural networks), as known by one of skill in the art. According to an example embodiment, a detection accuracy of DSP 110 may be configured to be higher than a detection accuracy of audio detector 104.

According to an example embodiment, DSP 110 may perform subsequent processing of audio signals 130 (e.g., with higher accuracy), after audio detector 104 detects the probable presence of the predetermined audio signal (in the low power mode). Subsequent detection of the predetermined audio signal by DSP 110 (after initial detection by audio detector 104) may be used by power controller 112 to fully power up device 100 in the normal power mode. In this manner, device 100 may provide multiple levels of processing of audio signals 130 to detect the predetermined audio signal, and to control power consumption in device 100.

According to one example embodiment, audio detector 104 may be a separate component from general processor 106. According to another example embodiment, audio detector 104 may be part of general processor 106 (e.g., implemented as software running on general processor 106), as indicated by dashed box 108.

Power controller 112 may receive detection signal 132 from audio detector 104 and may provide control signal 134 to clock signal generator 114. Control signal 134 of power controller 112 is used switch operation of device 100 between the low power mode and the normal power mode.

Clock signal generator 114 is configured to produce a first clock 118 and a second clock 120. It may also include a switch 116. First clock 118 is a relatively higher accuracy clock signal (with a higher clock rate) whereas second clock 120 is a lower accuracy clock signal (with a lower clock rate) which causes the devices to which it is applied to consume less power than first clock 120. Responsive to control signal 134 from power controller 112, clock signal generator 114 provides clock signal 136 to audio detector 104, general processor 106, DSP 110, optional transmitter 124 and optional receiver 126.

Because first clock 118 has a higher accuracy than second clock 120, running audio detector 104 (as well as general processor 106) with second clock 120 (in low power mode) may provide less accurate audio detection results than running DSP 110 with first clock 118 (in normal power mode). First and second clocks 118 and 120 may be configured in various ways. As one example, first clock 118 may be run from a crystal oscillator and second clock 120 may be run from an oscillator on silicon (e.g. an astable multivibrator or a buffer-ring oscillator).

Power controller 112 provides control signal 134 to clock signal generator 114 so as to control which one of clocks 118 and 120 is used at any time. Power controller 134 is configured so that when device 100 is in the low power mode, the lower power clock signal (second clock 120) is used. When device 100 is in the normal power mode, the higher power clock signal (first clock 118) is used.

In the normal power mode, all components of device 100 may be active and switch 116 may be set so that first clock 118 is active. In the low power mode, power controller 112 may set switch 116 so that second clock 120 is active. Power controller 112 may also deactivate various components of device 100 in the low power mode, such as DSP 110.

Device 100 may include storage device 122. Storage device 122 may store at least a portion of audio signals 130. Storage device 122 may also store one or more predetermined audio signals 214 (FIG. 2), one or more values from audio detector 104, general processor 106, DSP 110, power controller 112, optional transmitter 124, optional receiver 126 and/or optional antenna 128. Storage device 122 may include, for example, a RAM, volatile memory, non-volatile memory, a magnetic disk, an optical disk, flash memory or a hard drive. Items such as look up tables may be stored in flash memory or read only memory (ROM). These may be embedded or low power versions dedicated for this purpose. Similarly, some volatile, but low power hardware, possibly flip flops, may be used for storage in this mode.

According to an example embodiment, storage device 122 may store a portion of audio signals 130 (used by audio detector 104 for initial detection). The stored portion may be used by at least one subsequent processing stage (such as DSP 110 or a later processing stage of audio detector 104). If the subsequent stage powers up quickly, the amount of storage may be small enough to be both power and cost efficient. For example, if the subsequent stage powers up in 10 ms, then 160 samples of storage may be used to store an 8 kHz audio signal 130.

Because audio signals 130 may be available to subsequent stage(s) (via storage device 122), at least one of the earlier processing stages may not need to be extremely selective (i.e., have a high detection accuracy). For example, a moderate false positive detection rate (e.g., by audio detector 104) may be filtered out at a later stage (such as by DSP 110).

The storage of audio signals 130 may also, for example, allow later stage(s) to distinguish between multiple detection triggers while simultaneously allowing earlier stage(s) not to distinguish between these triggers. For example, an early stage (such as audio detector 104) may identify that voice was detected and a later stage (such as DSP 110) may examine the same data to determine that a particular word was spoken.

Device 100 may include one or more of optional transmitters 124 which convert signals into a format appropriate for transmission from optional antenna 128 or optional receivers 126 which convert radio signals into a suitable format received from optional antenna 128.

Device 100 may include other functional components (not shown), such as a power supply, an amplifier and/or a filter. These components may also have different operating characteristics when in the low power mode compared with the normal power mode. For example, amplifiers could be run in a lower current consumption mode in the low power mode. According to another example, clock references may have laxer tolerances in the low power mode (for example, an R-C clock might be sufficient in the low power mode, so that the crystals may be powered down). Examples of these techniques are described in U.S. Patent App. Pub. No. US 2011/0065413 to Singer.

Figure 1B:
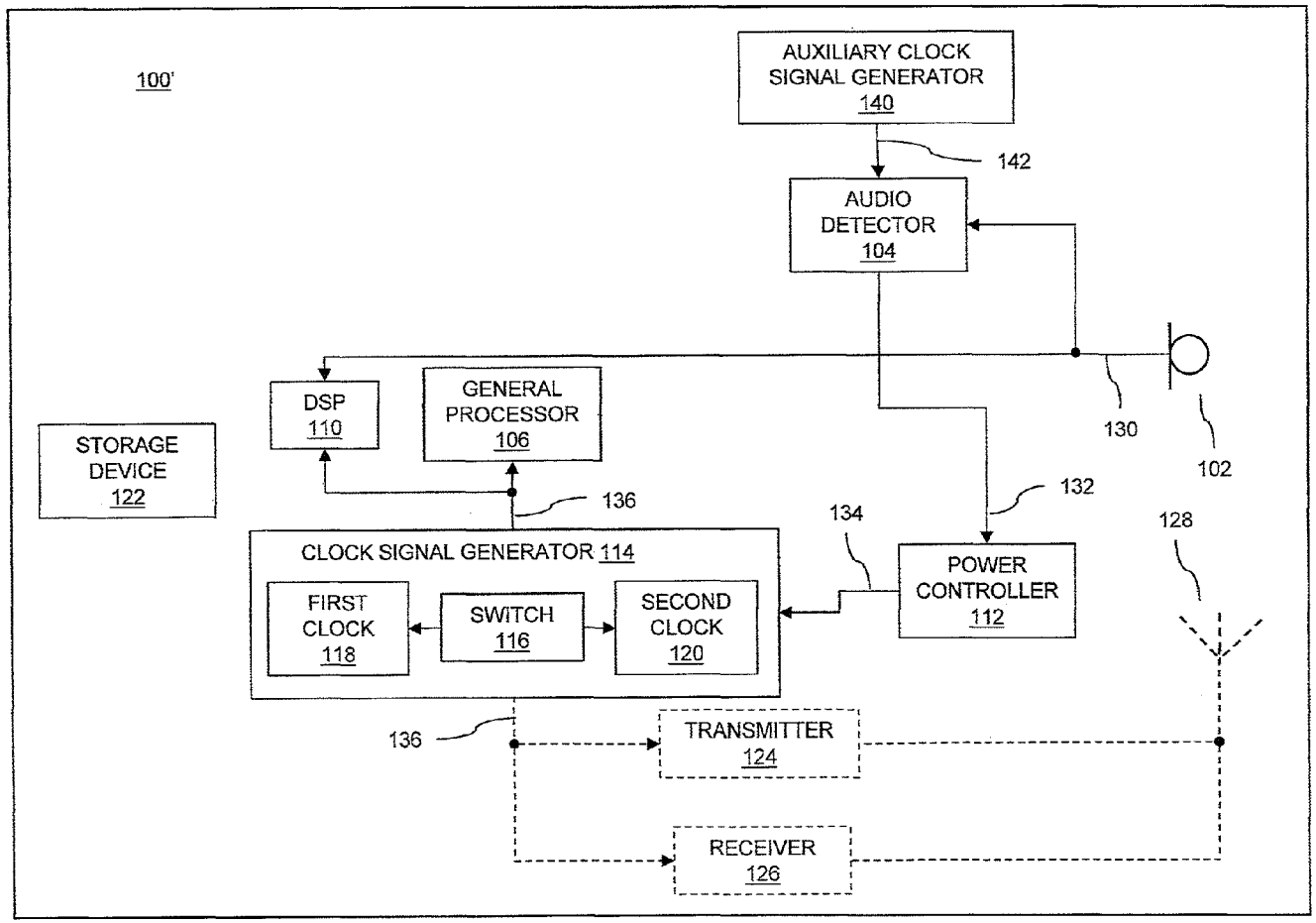
FIG. 1B is a functional block diagram of a device which detects a predetermined audio signal, according to another embodiment of the present invention.

Referring to FIG. 1B, a functional block diagram of an example device 100' is shown, according to another embodiment of the present invention. Device 100' is similar to device 100 (FIG. 1A), except that audio detector 104 in device 100' is clocked by clock signal 142 of auxiliary clock signal generator 140. Thus, in device 100', audio detector 104 may be clocked separately from the rest of components of device 100'. Audio detector 104 may also be powered independently of the other components of device 100'. Thus, audio detector 104 may reduce the processing power required by, and thus current consumed by, other components of device 100'.

Referring to FIGS. 1A and 1B, it is understood that components of one or more of audio detector 104, general processor 106, power controller 112, clock signal generator 114 and auxiliary clock signal generator 140 may be implemented in hardware or a combination of hardware and software. Although microphone 102, audio detector 104, general processor 106, DSP 110, power controller 112, clock signal generator 114, storage device 122, optional transmitter 124, optional receiver 126, optional antenna 118 and auxiliary clock signal generator 140 are illustrated as part of one system (for example, formed on a single chip), various components of device 100 (and device 100') may be formed separately.

It may be appreciated that hardware and/or software components of devices 100, 100' may be selected according to numerous factors, such as a desired power consumption and/or a desired materials cost.

For example, if aspects of the present invention are implemented on existing hardware which already includes a low power (i.e., low clock rate) microprocessor (i.e., general processor 106), additional components (such as audio detector 104 and power controller 112) may have to be added (such as from discrete components) to the hardware. This may increase the number of components and a required area of a printed circuit board (PCB).

In contrast, if aspects of the present invention are implemented as part of a new application-specific integrated circuit (ASIC), an increase in cost for adding some analog processing components, for example, may be marginal. These analog components, for example, may provide some simple processing (such as a noise gate) at lower power consumption than processing by a microprocessor. As another example, the analog components may occupy a smaller chip area than the chip area used to support extra ROM and/or RAM to extend the microprocessor's program and storage (to perform the audio detection processing).

Similarly, an ADC may consume a substantial amount of power. A noise gate implemented in a microprocessor on an existing system may also require continual use of an ADC. In contrast, a noise gate implemented with analog components may allow the ADC to be switched off until the input is determined to be sufficiently interesting (i.e., above a threshold).

Figure 2:
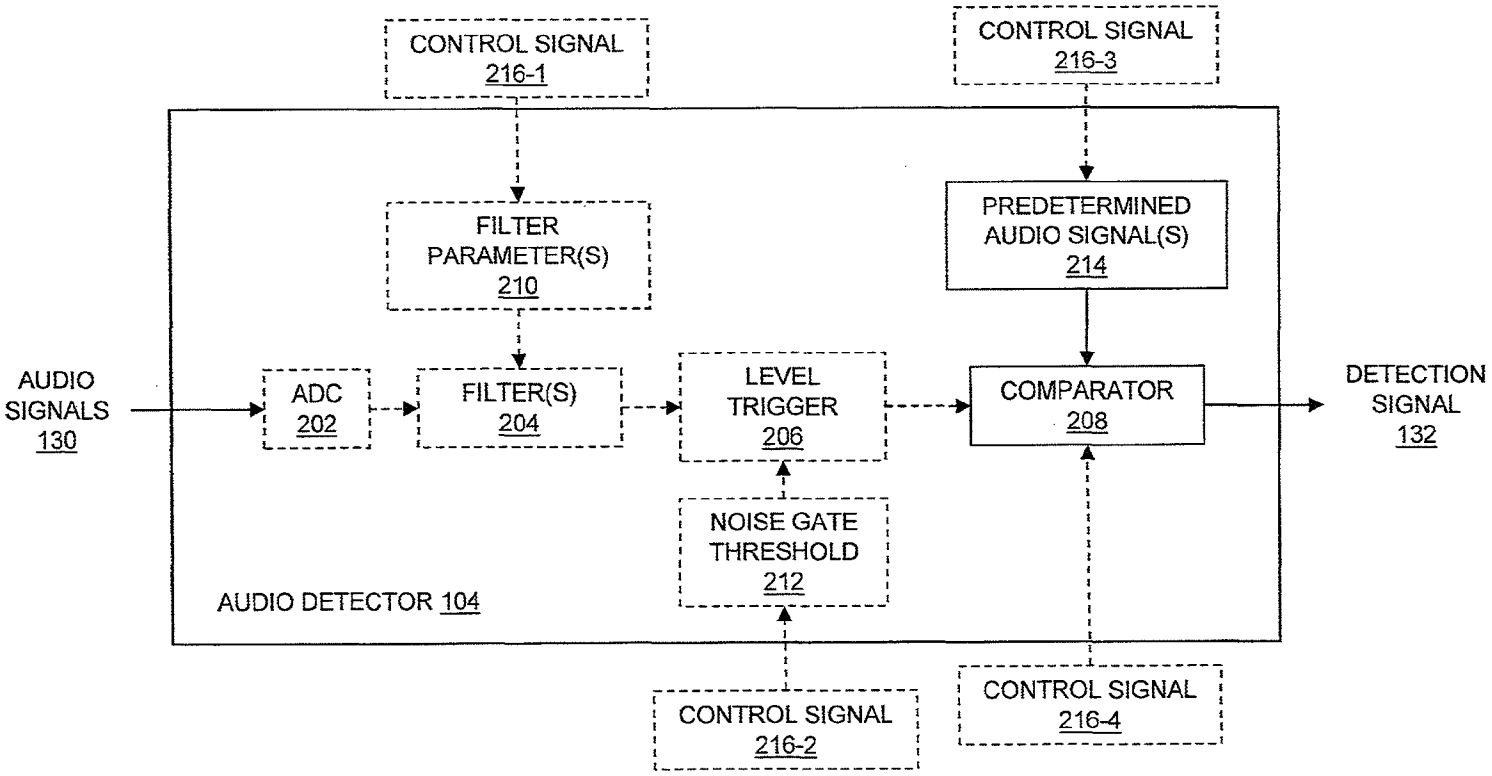
FIG. 2 is a functional block diagram of an audio detector of the devices shown in FIGS. 1A and 1B, according to an embodiment of the present invention.

Referring next to FIG. 2, a functional block diagram of audio detector 104 is shown. Audio detector 104 may include comparator 208. Audio detector 104 may also include one or more optional components such as analog to digital converter (ADC) 202, filter 204 (also referred to herein as filter(s) 204) and/or level trigger 206.

According to an exemplary embodiment, comparator 208 may receive audio signals 130 and may generate detection signal 132. In general, comparator 208 may compare audio signals 130 to a predetermined audio signal 214 (also referred to herein as predetermined audio signal(s) 214) to generate detection signal 132. For example, comparator 208 may compare frequency components of audio signals 130 with predetermined audio signal(s) 214, to detect the probable presence of predetermined audio signal(s) 214. Comparator 208 is described further below with respect to FIG. 3.

As discussed above, audio signals 130 may include an analog signal or a digital signal. Thus, comparator 208 may be configured to process audio signals 130 in the analog domain and/or in the digital domain.

Although a single comparator 208 is shown in FIG. 2, audio detector 104 may include two or more comparators 208. According to an example embodiment, each comparator 208 may provide different detection accuracy. According to another example embodiment, each comparator 208 may provide different levels of comparison. Examples of comparison may include: whether the audio signal contains voice signals compared to non-voice signals; whether the audio contains a user's voice (or one of a set of users' voices) compared to other voices; or whether the audio contains specific keywords compared to other noises produced by the user. As discussed above, predetermined audio signal(s) 214 may also include predetermined non-voice signals, such as, without being limited to, a whistle, a clap or a click.

Audio detector 104 may include optional ADC 202. Optional ADC 202 may receive audio signals 130 as an analog signal, and may convert audio signals 130 to a digital signal. ADC 202 may provide a digital signal to comparator 208 (or to optional filter(s) 204 or to optional level trigger 206). In an example embodiment, in the low power mode, ADC 202 may operate with a lower accuracy clock (such as using second clock 120 shown in FIG. 1A) or at a lower frequency than during the normal power mode.

Audio detector 104 may include optional filter(s) 204. Filter(s) 204 may receive audio signals 130 (or a digitized signal from optional ADC 202) and provide a filtered signal to comparator 208 (or to optional level trigger 206). Optional filter(s) 204 may be configured with filter parameter(s) 210. Optional filter(s) 204 may include any suitable analog domain or frequency domain filters, such as, low pass filters, high pass filters, band pass filters, notch filters, or any combination thereof.

According to an example embodiment, optional filter(s) 204 may include a high pass filter, to attenuate a direct current (DC) component, for reducing false positive audio detection. According to another example embodiment, optional filter(s) 204 may include a band pass filter to pass a range of frequencies corresponding to voice (for example, between about 50 Hz and about 4 kHz).

Audio detector 104 may include optional level trigger 206. Optional level trigger 206 may receive audio signals 130 (or a digitized signal from optional ADC 202 or a filtered signal from optional filter(s) 204) and may provide a trigger signal to comparator 208. Optional level trigger 206 may compare a level of audio signals 130 to optional noise gate threshold 212. If the level of audio signals 130 is greater than optional noise gate threshold 212, optional level trigger 206 may trigger comparator 208 to analyze audio signals 130. Otherwise, comparator 208 may not analyze audio signals 130. Thus, optional level trigger 206 may operate as a noise gate.

According to an example embodiment, optional level trigger 206 may receive the analog signal and generate a noise-gated signal. The noise-gated signal may be provided to comparator 208 for analysis. Thus, comparator 208 may be able to obtain, effectively a one bit per sample audio signal for processing.

As discussed above with respect to FIG. 1A, device 100 may include storage device 122, which may store at least a portion of audio signals 130. Storage of audio signals 130 may be controlled during different stages of audio detector 104. For example, storage may be non-volatile and may not be active unless optional level trigger 206 provides a trigger signal to comparator 208. This could allow storage device 122 (FIG. 1A) to be powered off for the majority of the lifetime of device 100 (in the low power mode).

According to an example embodiment, audio detector 104 may include a microprocessor, which may perform the processing during the low power mode (with low power components). It may be desirable to run audio detector 104 independently from general processor 106 (FIG. 1A) of device. In the low power mode, general processor 106 (FIG. 1A) may be configured into a low leakage current state, by placing its RAMs into a low voltage data retention state. In this state, the RAMs of general processor 106 (FIG. 1A) may not be accessed. Accordingly, audio detector 104 (e.g., a microprocessor) may include RAM (not shown) separate from the RAM of general processor 106 (FIG. 1A). In some cases, general processor 106 (FIG. 1A) may be powered off completely (losing its RAM contents but saving power). General processor 106 (FIG. 1A) may also include non-volatile RAM (NVRAM) to retain its contents when powered off.

According to an example embodiment audio detector 104 may be formed from passive components. According to another example embodiment, one or more components of audio detector may be adjusted. For example, at least one component may be adjusted (adapted) responsive to changes in environmental noise conditions. According to another example embodiment, one or more components of audio detector may be trained to detect predetermined audio signal(s) 214 under various noise conditions. According to a further exemplary embodiment, one or more components of audio detector may be capable of learning new predetermined audio signal(s) 214 and/or new noise conditions.

Adjustment of at least one of optional filter parameter(s) 210, optional noise gate threshold 212, predetermined audio signal(s) 214 and comparator 208 is generally indicated by respective optional control signals 216-1, 216-2, 216-3 and 216-4. Control signals 216 may be provided, for example, by general processor 106 (FIG. 1A).

For example, during training, audio detector 104 may attempt to find filter bank parameters 312 (FIG. 3) of comparator 208 (via control signal 216-4) that identify different parts of a keyword with good selectivity. To cope with environmental noise, audio detector 104 (via control signal 216-1) may alter optional filter parameter(s) 210 away from ideal settings for a noise-free environment to reduce noise degradation of audio signals 130. As another example, audio detector 104 (via control signal 216-2) may alter optional noise gate threshold 212 away from ideal settings for the noise free environment to reduce false positive triggering by optional level trigger 206.

The adaptability of audio detector 104 may be selected to target a particular ratio of wake-ups (i.e., switching to the normal power mode) being, true positives or a particular minimum wake-up rate when using non-ideal settings (e.g., for noisy environments).

According to an example embodiment, audio detector 104 may be adapted to react to false positives. According to another example embodiment, audio detector 104 may be adapted to compensate for false positives and false negatives. For example, audio detector 104 may alter thresholds and/or other parameters to reduce false positives. Over time, unfortunately, audio detector 104 may reduce the number of false positives while gradually becoming less sensitive to the true positives. With a multi-stage audio detector, if the first stage rejects too many signals, there may be no way to identify false negatives without user interaction. However, if the first stage (such as optional level trigger 206 or one stage of comparator 208) allows some false positives through, later stages can use these false positives to ensure that audio detector 104 does not become insensitive to true positives. Audio detector 104 may also allow some target levels of false positives to ensure no or few false negatives.

According to an example embodiment, for environmental adaptation, one or more components of audio detector 104 (or of device 100 of FIG. 1A) may wake up periodically to sample the background noise and/or to adjust filter parameters or other parameters of audio detector 104. For example, device 100 may determine the background noise level and adjust noise gate threshold 212 to be just above the background noise level, effectively generating a rolling average estimate of the current background noise level.

Although periodic wake up of components of device 100 (FIG. 1A) may be expensive in terms of power, it may be possible to suppress the wake up when it is known that the environment is quiet. For example, at night the user may typically leave device 100 in a quiet area. Device 100 may set noise gate threshold 212 to a relatively low value and turn off periodic environmental noise adaptation. Device 100 may, thus, be confident that any change in the environment may cause optional level trigger 206 to provide a trigger signal for initial audio detection.

In the above example, it may be appreciated that audio detector 104 may wake up the full device 100 (FIG. 1A) in response to a user's trigger; and may also wake up the full device 100 in response to change in environment. This double triggering may be generalized. In some cases, particularly with constant or near-constant environments (such as driving) the high power mode components of device 100 may teach the low power mode components to wake it up either for a trigger or for a change in the environment.

Adaptability of audio detector 104 may be assisted by storing of audio signals 130 (such as in storage device 122 of FIG. 1A) during operation in the low power mode. This may allow the full device 100 (FIG. 1A), in the normal power mode, to determine the exact signal that caused triggering of audio detector 104 (in the low power mode). For example, this signal may be applied to a model of the low power circuit with varying parameters to determine new parameters for audio detector 104.

According to an example embodiment, parameters of audio detector 104 may be kept constant when device 100 (FIG. 1A) is in the low power mode. If adaptation is desired, device 100 may be brought into the normal power mode. Device 100 (FIG. 1A) (in the normal power mode) may then determine new parameters, load them into audio detector 104 and return to the low power mode.

According to another example embodiment, sufficiently sophisticated components of audio detector 104 may be capable of being adapted while remaining in the low power mode (i.e., without switching to the normal power mode as described above). For example, audio detector 104 may be able to adapt an initial noise gate threshold 212 while remaining in the low power mode but may switch to the normal power mode to identify a persistent background noise and calculate settings for components of audio detector 104 that may suppress the background noise.

Audio detector 104 may be capable of being adapted according to other techniques. For example, audio detector 104 may examine a new portion of audio signals 130 after comparator 208 is triggered by optional level trigger 206, to adjust parameters of audio detector 104.

For example, device 100 (FIG. 1A) may assume that the new portion of audio signals 130 is similar to the signal that caused triggering of level trigger 206. Storage device 122 (FIG. 1A) may be configured to store 10 ms of audio. This amount of audio may be of sufficient length between triggering by level trigger 206 until the next stage (comparator 208) is ready to process this audio. Accordingly, comparator 208 may expect a voice signal (for example) to follow the trigger. If the voice signal is not detected, audio detector may determine whether audio signals 130 are continuously above noise gate threshold 212 (i.e., whether noise gate threshold 212 is producing false positives). If so, noise gate threshold 212 may be adjusted (or optional filter parameter(s) 210 may be adjusted).

In general, 10 ms of storage may not be of sufficient duration to store a whole keyword trigger. For an entire keyword, it may be desirable to store about 1 to 2 seconds of audio signals 130. In general, it may be desirable to store between about 10 ms to about 2 seconds of audio signals 130. More preferably, it may be desirable to store about 100 ms of audio signals 130. For example, a 100 ms duration may be sufficient to detect that the user is speaking but not the specific word. A 100 ms duration may be long enough to identify a phoneme or, more specifically, that the user is probably speaking the first phoneme of a keyword. If device 100 (FIG. 1A) records, for example, 8 bit samples at 4 kHz during that time, only 800 bytes of storage may be needed. With 1 kB of storage, device 100 may be able to increase sampling of any ADCs up to 16 bit samples at 16 kHz while a next stage gets ready for audio detection.

Figure 3:
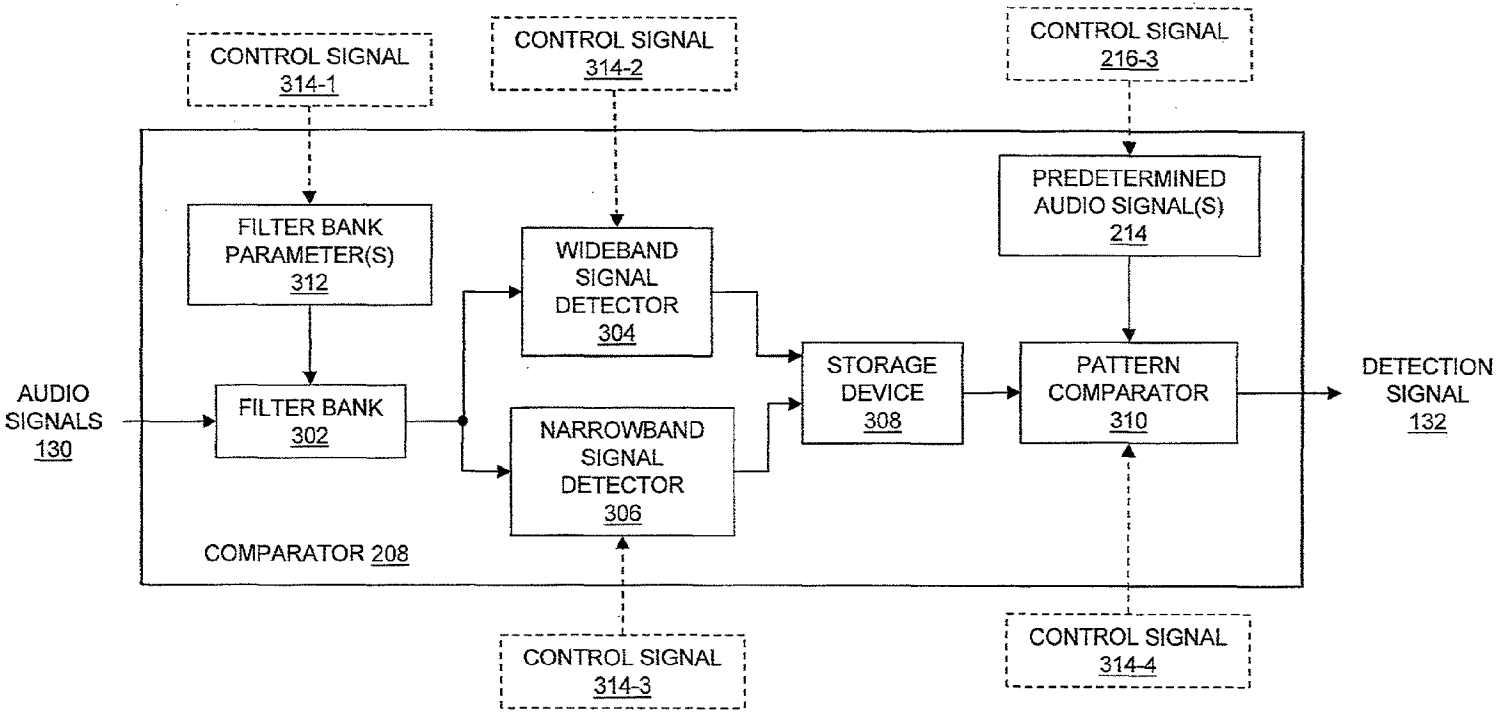
FIG. 3 is a functional block diagram of a comparator of the audio detector shown in FIG. 2, according to an embodiment of the present invention.

Referring next to FIG. 3, a functional block diagram of comparator 208 is shown. Comparator 208 may include filter bank 302, wideband signal detector 304, narrowband signal detector 306, storage device 308 and pattern comparator 310.

Filter bank 302 may receive audio signals 130 and may apply a plurality of filters to audio signals 130, according to one or more filter bank parameters 312 (referred to herein as filter bank parameter(s) 312). Filter bank 302 may include any suitable analog domain or frequency domain filters, such as, low pass filters, high pass filters, band pass filters, notch filters, or any combination thereof.

For example, filter bank 302 may filter audio signals 130 into three frequency bands, such as a low frequency band, a mid-frequency band and a high frequency band corresponding to frequencies associated with a user's voice (e.g., audio of interest). In general, filter bank parameter(s) 312 of filter bank 302 may represent frequencies indicative of a probable presence of predetermined audio signal(s) 214 in audio signals 130.

Filter bank parameter(s) 312 may represent filter parameters for filter banks corresponding to a number of different predetermined audio signals 214. Selection of filter bank parameter(s) 312 may be controlled, for example, by control signal 314-1. Thus, filter bank 302 may be adjusted to detect a number of different predetermined audio signals 214 (such as a number of different voices).

A plurality of filtered signals from filter bank 302 may be provided to wideband signal detector 304 and narrowband signal detector 306. Wideband detector 304 may analyze a variation in the filtered signals over a wide range of frequencies whereas narrowband detector 306 may analyze a variation in the filtered signals over a narrow range of frequencies. Each detector 304, 306 may compare the analyzed signals to a respective (wideband or narrowband) detection threshold. If the analyzed signals are greater than the respective detection threshold, the corresponding detector may output a respective detection indication.

For example, voice may contain a mixture of consonants and vowels. Vowels are typically a narrow bandwidth signal (a small range of frequencies), whereas consonants are a wide bandwidth signal (a large range of frequencies). Each detector 304, 306 may simultaneously perform the respective analysis over time. Accordingly, over time, the outputs of detectors 304 and 306 may indicate a pattern of wideband and narrowband signals.

The detection thresholds and other parameters of wideband signal detector 304 and narrowband signal detector 306 may be adjusted, for example, by respective control signals 314-2 and 314-3. For example detectors 304 and 306 may be adjusted to correspond to a number of different predetermined audio signals 214.

Although wideband signal detector 304 and narrowband signal detector 306 are shown in FIG. 3, in general, any suitable number of detectors may be used to detect a variation over time in the filtered signals (from filter bank 302) over one or more frequency bands. For example, a number of narrowband signal detectors 306 may analyze a variation in the power in different frequency bands over time.

In general, detectors 304 and 306 may perform the frequency analysis using any suitable technique, such as, without being limited to, a fast Fourier transform (FFT) in the frequency domain, or techniques in the analog domain. Variations in specific frequencies may be used to identify whether it is likely that predetermined audio signal(s) 214 is in audio signals 130.

Storage device 308 may receive and store the detection results from detectors 304 and 306 over a period of time, as a detected pattern. Storage device 308 may include, for example, a shift register, a random access memory (RAM), a magnetic disk, an optical disk, flash memory or a hard drive.

Pattern comparator 310 may receive the detected pattern stored in storage device 308. The detected pattern may be compared to predetermined audio signal(s) 214. If the detected pattern is substantially similar to predetermined audio signal(s) 214, pattern comparator 310 may indicate the detected presence of predetermined audio signal 214, by detection signal 132.

For example, pattern comparator 310 may analyze a mix of wideband and narrowband signals (from the detected pattern) at time intervals consistent with predetermined spoken words. It is understood that careful choice of keywords (such as multi-syllable keywords) to wake-up device 100 (FIG. 1A) may improve the audio detection accuracy.

Parameters of pattern comparator 310 may be adjusted, for example, by control signal 314-4. For example, a detection accuracy of pattern comparator 310 may be adjusted.

As discussed above with respect to FIG. 2, one or more components of comparator 208 may be adjusted, for example, responsive to changes in environmental noise conditions. According to another example embodiment, one or more components of comparator 208 may be trained to detect predetermined audio signal(s) 214 under various noise conditions. According to a further exemplary embodiment, one or more components of comparator 208 may be capable of learning new predetermined audio signal(s) 214 and/or new noise conditions. Adjustment of comparator 208 is generally indicated by respective optional control signals 314-1, 314-2, 314-3 and 314-4. Control signals 314 may be provided, for example, by general processor 106 (FIG. 1A).

For example, audio detector 104 (FIG. 2) may be configured to learn new keywords. A user may be asked to repeat a new keyword so that audio detector 104 can learn and store the new keyword. Repeated unsuccessful attempts to learn the new keyword may cause comparator 208 (and/or other optional components of audio detector 104) to adjust one or more of its parameters.

Figure 4:
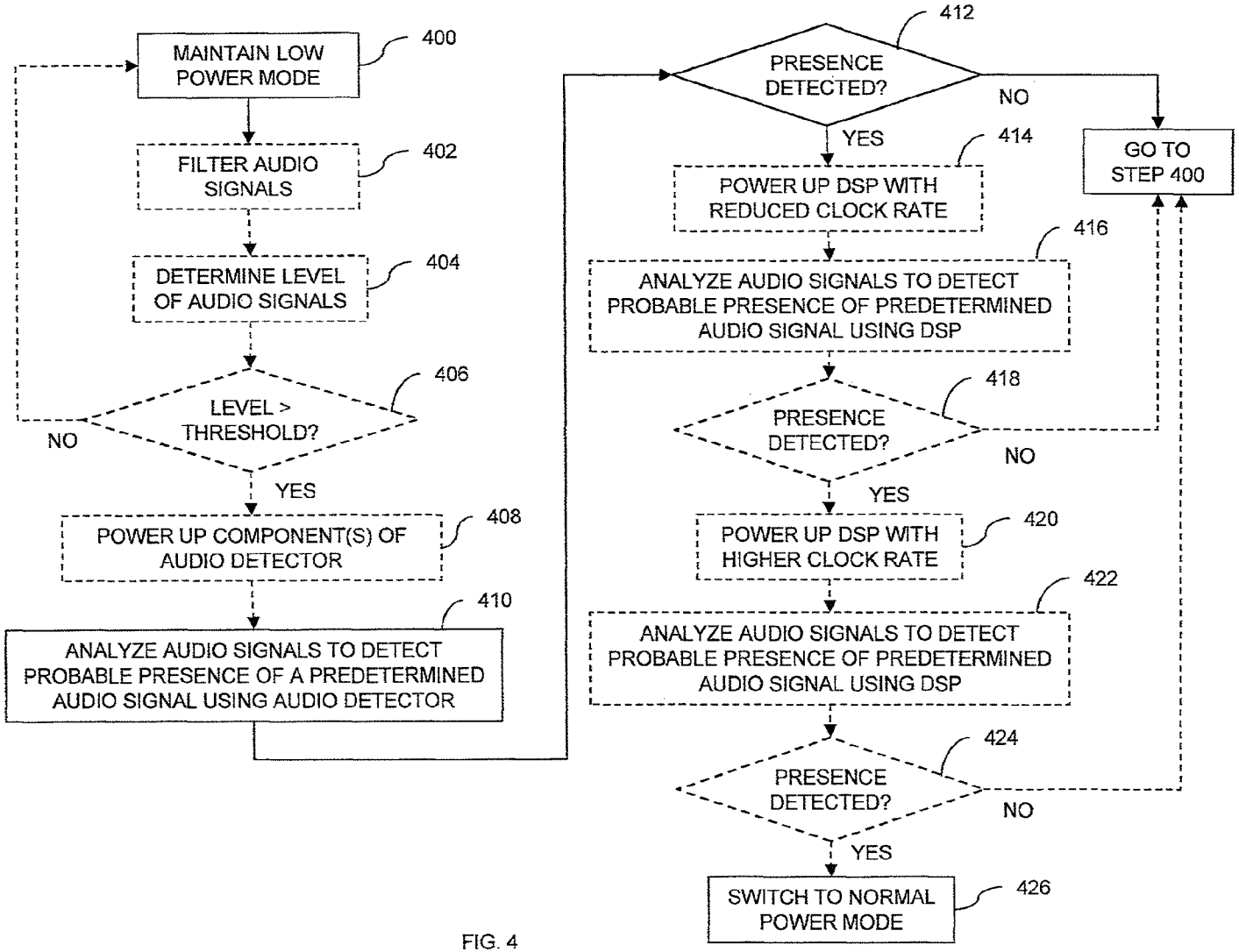
FIG. 4 is a flowchart diagram of a method of detecting a predetermined audio signal, according to an embodiment of the present invention.

Referring next to FIG. 4, a flowchart diagram of an example method of detecting a predetermined audio signal is shown. At step 400, device 100 (FIG. 1A) is maintained in a low power mode. For example, power controller 112 (FIG. 1A) may control clock signal generator 114 to use second clock 120 (a lower accuracy clock) to provide clock signal 136 to components of device 100, including general processor 106.

At optional step 402, audio signals 130 may be filtered, for example, by at least one filter 204 of audio detector 104 (FIG. 2). At optional step 404, a level of audio signals 130 may be determined, for example, by level trigger 206 of audio detector 104 (FIG. 2). At optional step 406, it is determined whether the level of audio signals 130 is greater than noise gate threshold 212, for example, by level trigger 206 of audio detector 104 (FIG. 2).

If it is determined, at optional step 406, that the level of audio signals 130 is greater than noise gate threshold 212, optional step 406 may proceed to optional step 408. At optional step 408, one or more additional components of audio detector 104 (FIG. 2) may be powered up. For example, audio detector 104 may power up comparator 208 (FIG. 2). Optional step 408 may proceed to step 410.

If it is determined, at optional step 406, that the level of audio signals 130 is less than or equal to noise gate threshold 212, optional step 406 may proceed to step 400. One or more of optional steps 402-408 may be repeated.

At step 410, audio signals 130 are analyzed to detect a probable presence of a predetermined audio signal 214 in audio signals 130, for example, by comparator 208 of audio detector 104 (FIG. 2). At step 412, it is determined whether the presence of predetermined audio signal 214 is detected, for example, by comparator 208 of audio detector 104 (FIG. 2).

If it is determined, at step 412, that the predetermined audio signal 214 is detected, step 412 may proceed to optional step 414. At optional step 414, DSP 110 of device 100 (FIG. 1A) may be powered up. DSP 110 may be powered up and operated at a reduced clock rate, such as by second clock 120 of clock signal generator 114 (FIG. 1A). Optional step 414 may proceed to optional step 416. According to another example embodiment, upon detection of predetermined audio signal 214 (step 412), audio signals 130 may be stored (for example, in storage device 122 (FIG. 1A)) or predetermined audio signal 214 may be repeated by the user (to confirm that predetermined audio signal 214 was indeed indicated).

If it is determined, at step 412, that predetermined audio signal 214 is not detected, step 412 may proceed to step 400.

At optional step 416, audio signals 130 are analyzed to detect the probable presence of predetermined audio signal 214 in audio signals 130, for example, by DSP 110 at a reduced clock rate (FIG. 1A). At optional step 418, it is determined whether predetermined audio signal 214 is detected, for example, by DSP 110 of device 100 (FIG. 1A).

If it is determined, at optional step 418, that predetermined audio signal 214 is detected, optional step 418 may proceed to optional step 420. At optional step 420, DSP 110 of device 100 (FIG. 1A) may be powered up and operated at a higher clock rate, such as by first clock 118 of clock signal generator 114. Optional step 420 may proceed to optional step 422.

If it is determined, at optional step 418, that predetermined audio signal 214 is not detected, optional step 418 may proceed to step 400.

At optional step 422, audio signals 130 are analyzed to detect the probable presence of predetermined audio signal 214 in audio signals 130, for example, by DSP 110 at the higher clock rate (FIG. 1A). At optional step 424, it is determined whether predetermined audio signal 214 is detected, for example, by DSP 110 of device 100 (FIG. 1A).

If it is determined, at optional step 424, that predetermined audio signal 214 is detected, optional step 424 may proceed to step 426.

At step 426, device 100 may be switched to the normal power mode. For example, power controller 112 (FIG. 1A) may control clock signal generator 114 to use first clock 118 (a higher accuracy clock) to provide clock signal 136 to components of device 100, including general processor 106.

If it is determined, at optional step 424, that predetermined audio signal 214 is not detected, optional step 424 may proceed to step 400.

Steps 400-424 may be continuously or periodically repeated until predetermined audio signal 214 is detected. In general, steps 410-412 (more advanced audio processing capability) combined with optional steps 402-408 (reduced audio processing capability) and/or optional steps 414-424 (most advanced audio processing capability, such as voice recognition processing with HMMs) may be used to trade-off power consumption against audio processing capability.

Although the invention has been described in terms of devices and methods of detecting the probable presence of a predetermined audio signal, it is contemplated that one or more products may be implemented in software on microprocessors/general purpose computers (not shown). In this embodiment, one or more of the functions of the various components may be implemented in software that controls a general purpose computer. This software may be embodied in a non-transitory computer readable medium, for example, RAM, a magnetic or optical disk or a memory-card.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method, performed by a device, of detecting an audio signal of interest in a number of audio signals, the method comprising:

operating the device in a low power mode having a relatively low power consumption;

detecting, in the low power mode, a probable presence of the audio signal of interest by:

filtering, using a filter bank, the number of audio signals to include only frequencies corresponding to the audio signal of interest;

detecting, using a narrowband signal detector and a wideband signal detector, variations in the filtered audio signals over a narrow bandwidth and a wide bandwidth, respectively; and comparing, using a pattern comparator, the detected variations in the filtered audio signals with frequency characteristics of a comparison signal; and switching the device from the low power mode to a normal power mode based on the detected probable presence of the audio signal of interest, the normal power mode having a relatively high power consumption.

2. The method of claim 1, wherein the audio signal of interest includes a voice signal.

3. The method of claim 1, further comprising:

storing at least a portion of the number of audio signals based on detection of the probable presence of the audio signal of interest.

4. The method of claim 1, wherein detecting the probable presence of the audio signal of interest is performed with a first detection accuracy, the method further comprising:

further detecting the probable presence of the audio signal of interest with a second detection accuracy that is higher than the first detection accuracy, the device being switched from the low power mode to the normal power mode based on the further detected presence of the audio signal of interest.

5. The method of claim 4, wherein the further detecting of the probable presence of the audio signal of interest is performed in the low power mode.

6. The method of claim 4, wherein the further detecting of the probable presence of the audio signal of interest is performed with a higher clock rate than a clock rate associated with the low power mode.

7. The method of claim 1, further comprising:

prior to detecting of the probable presence of the audio signal of interest, applying at least one filter having a filter characteristic to the number of audio signals.

8. The method of claim 1, further comprising:

prior to detecting the probable presence of the audio signal of interest:

determining a level of the number of audio signals;

comparing the level to a threshold; and when the level is greater than the threshold, performing the detecting of the probable presence of the audio signal of interest.

9. The method of claim 1, wherein detecting the probable presence of the audio signal of interest includes:

detecting a pattern in the number of audio signals; and comparing the detected pattern to the audio signal of interest.

10. The method of claim 9, wherein detecting the pattern includes monitoring a variation in at least one frequency of the number of audio signals over time, the at least one frequency associated with the audio signal of interest.

11. The method of claim 1, further comprising:

determining an accuracy of the detection of the probable presence of the audio signal of interest; and adjusting at least one parameter for detecting the probable presence of the audio signal of interest based on the determined accuracy.

12. A device comprising:

a processor coupled to a clock signal generator;

a power controller configured to operate the device in a low power mode having a relatively low power consumption or in a normal power mode having a relatively high power consumption; and an audio detector, coupled to the power controller, and configured to detect, in the low power mode, a probable presence of an audio signal of interest in a number of audio signals, the audio detector comprising:

a filter bank configured to filter the number of audio signals to include only frequencies corresponding to the audio signal of interest;

a narrowband signal detector configured to detect variations in the filtered audio signals over a narrow bandwidth;

a wideband signal detector configured to detect variations in the filtered audio signals over a wide bandwidth; and a pattern detector configured to compare the detected variations in the filtered audio signals with frequency characteristics of a comparison signal, wherein the power controller is further configured to switch the device from the low power mode to the normal power mode based on the detected probable presence of the audio signal of interest.

13. The device of claim 12, wherein the audio signal of interest includes a voice signal.

14. The device of claim 12, further including a storage device for storing at least a portion of the number of audio signals.

15. The device of claim 12, wherein the audio detector is configured to detect the probable presence of the audio signal of interest with two or more different detection accuracies.

16. The device of claim 12, wherein the audio detector is included in the processor.

17. The device of claim 12, wherein the audio detector is separate from the processor.

18. The device of claim 12, further comprising a digital signal processor (DSP) coupled to the clock signal generator, the DSP configured to further detect the probable presence of the audio signal of interest with a higher detection accuracy than the audio detector.

19. The device of claim 12, wherein the audio detector includes at least one filter having a filter characteristic to filter the number of audio signals.

20. The device of claim 12, wherein the audio detector includes a level trigger to compare a level of the number of audio signals to a threshold.

21. The device of claim 12, wherein the audio detector includes a comparator configured to detect a pattern in the number of audio signals and to compare the detected pattern to the audio signal of interest.

22. The device of claim 21, wherein the comparator is configured to monitor a variation in at least one frequency of the number of audio signals over time, the at least one frequency associated with the audio signal of interest.

23. The device of claim 12, further comprising a microphone configured to capture the number of audio signals.

24. The device of claim 12, wherein the device is configured to adjust at least one parameter of the audio detector.

25. The device of claim 24, wherein the at least one parameter is adjusted based on at least one of a detection accuracy of a detection result of the audio detector, a noise condition, or a new audio signal of interest.

26. The method of claim 1, wherein the audio signal of interest includes a non-voice audio signal that is at least one member of the group consisting of a whistle, a clap, and a click.

27. The method of claim 2, wherein the voice signal is at least one member of the group consisting of a user's voice, a set of user voices, and one or more keywords.

28. The device of claim 12, wherein the audio signal of interest includes a non-voice audio signal that is at least one member of the group consisting of a whistle, a clap, and a click.

29. The device of claim 13, wherein the voice signal is at least one member of the group consisting of a user's voice, a set of user voices, and one or more keywords.

* * * * *